US006523295B1

(12) United States Patent
Midgley

(10) Patent No.: US 6,523,295 B1
(45) Date of Patent: Feb. 25, 2003

(54) BEHAVIOR MODIFICATION DEVICE FOR HANDGUNS

(76) Inventor: James Midgley, P.O. Box 61032, Fort Myers, FL (US) 33906

( * ) Notice: Subject to any disclaimer, the term of this patent is extended or adjusted under 35 U.S.C. 154(b) by 0 days.

(21) Appl. No.: 09/940,380

(22) Filed: Aug. 28, 2001

(51) Int. Cl.[7] ..... F41A 17/00; F41A 17/06
(52) U.S. Cl. ..... 42/70.01; 42/70.11; 42/1.01
(58) Field of Search ..... 42/70.01, 70.11, 42/1.01

(56) References Cited

U.S. PATENT DOCUMENTS 3,842,526 A * 10/1974 Dixon ..... 42/1.01
4,739,569 A * 4/1988 Battle ..... 42/1.01
5,437,117 A * 8/1995 Mackey, III ..... 42/1.01
5,508,683 A * 4/1996 Hall ..... 340/571
5,603,180 A * 2/1997 Houze ..... 42/1.01
5,715,623 A * 2/1998 Mackey, III ..... 42/1.01
5,860,241 A * 1/1999 Waters ..... 42/66
5,915,936 A * 6/1999 Brentzel ..... 42/70.11

* cited by examiner

*Primary Examiner*—Charles T. Jordan
*Assistant Examiner*—John W. Zerr
(74) *Attorney, Agent, or Firm*—Michael I. Kroll

(57) ABSTRACT

A gun handling deterrent device includes a housed, battery-powered electrical assembly for placement within the gun handle, with sub-assemblies to convert the DC to pulsating DC and step up the voltage, and leads to the gun frame and a negative contact member that extends from the handle for positioning adjacent the handle, trigger guard and barrel, such that when the handle, trigger guard or barrel is grasped, the hand contacts both the metal frame and the negative contact member. An actuator switch enables the circuit when the gun is moved from a horizontal position, causing the increased voltage pulsating DC to be delivered to the hand. The shock function is joined or replaced in embodiments where an audio generating device is activated by the actuator switch when the gun is so moved.

27 Claims, 17 Drawing Sheets

BEHAVIOR MODIFICATION DEVICE FOR HANDGUNS

BACKGROUND OF THE INVENTION

1. Field of the Invention

The present invention relates generally to gun safety devices, and more specifically, to a behavioral conditioning device.

2. Description of the Prior Art

There are numerous gun safety devices. While these gun safety devices may be suitable for the purposes for which they were designed, they would not be as suitable for the purposes of the present invention as heretofore described. It is thus desirable to provide a behavior modification device for handguns that deters unwanted handling of the gun by shocking the person as the gun is grasped about its handle, trigger guard or barrel. The device should be battery powered and be actuated by the movement of the handgun from its stored, horizontal position.

SUMMARY OF THE PRESENT INVENTION

A primary object of the present invention is to provide a behavior modification device for handguns that will use negative reinforcement to teach gun safety by supplying an electrical charge to a gun frame to apply a mild shock to anyone that picks it up from a horizontal position.

An additional object of the present invention is to provide a behavior modification device for handguns that will remain dormant when lying on it is side until the gun is moved whereupon a circuit actuator will initiate an electrical charge throughout the frame of the handgun until the gun is returned to the horizontal position.

Another object of the present invention is to provide a behavior modification device for handguns that when applied to semi-automatic handguns is housed in a clip similar to the ammunition magazine and when applied to revolvers may be housed within the frame of the handle.

A yet further object of the present invention is to provide a behavior modification device for handguns wherein the circuit actuator has a body with a circular sidewall and a substantially conical top and bottom. A bare wire conductor runs circumferentially along the interior of the sidewall and a highly conductive metal ball rolls freely within and rests in the conical bottom or top when the gun is laying flat. When the gun is picked up the conductive ball rolls to the sidewall and simultaneously contacts the bare wire conductor and the conductive conical top or bottom, thus completing the circuit, allowing current to the transformer for stepping up the voltage from the voltage of the battery.

Still another object of the present invention is to provide a behavior modification device for handguns that uses either electrical shock, an alarm, recorded voice commands or any combination thereof to alert the user to not handle the handgun.

One more object of the present invention is to provide a behavior modification device for handguns that is simple and easy to use.

A further object of the present invention is to provide a behavior modification device for handguns that is economical in cost to manufacture.

Further objects of the present invention will appear as the description proceeds.

A behavioral conditioning device uses pulsating DC current to electrify the frame of a handgun when the gun is moved from the prone horizontal position to transmit a mild shock to the person handling the gun so as to teach children to respect guns. The present invention could be installed in a clip for use with semiautomatic handguns or integrated within the handle of a revolver. Mock weapons utilizing the present invention could also be used in place of actual weapons for training purposes.

DC from the batteries is converted to pulsating DC by an electromagnetic vibrator. This pulsating DC works like alternating current to energize the primary of a transformer, the output of which is a voltage high enough to produce a mild shock.

A device is provided for deterring the grasping of a handgun by a person's hand, the handgun having a metal frame with a handle, trigger guard and a barrel, the handle being adapted to receive a magazine, the device being powered by a battery having a positive terminal and a negative terminal, the device comprising: a housing, the housing being adapted to be received and secured at least partially within the gun handle in place of the magazine; and an electrical assembly at least partially within the housing, the electrical assembly being in electric communication with the positive and negative terminals of the battery, the electrical assembly having: a first electrical sub-assembly for converting the battery DC to pulsating DC; a second electrical sub-assembly for increasing the pulsating DC voltage; an actuator switch, the actuator switch moving from off to on when the gun is moved from a horizontal position; a positive contact member receiving the increased voltage pulsating DC from the second electrical sub-assembly, the positive contact member being positioned on the housing such that the gun metal frame receives pulsating DC from the positive contact member; and a negative contact member positioned adjacent the gun handle such that the negative contact member is insulated from the gun metal frame and in electric communication with the battery negative terminal, such that when the housing is positioned in the gun handle, a person's hand grasping the gun handle will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

In another embodiment, the actuator switch comprises: a circular member having a cylindrical wall, a conical top and a conical bottom, the wall being non-conductive, the top and bottom being conductive and in electric communication with the positive contact member, the wall having an interior surface; an exposed member positioned about the wall interior surface circumference, the member being in electric communication with the battery positive terminal; a ball within the cylinder, the ball being conductive, the ball being sized such that: when the switch is in a first horizontal position, the ball rests in the conical bottom and does not contact the exposed member; when the switch is in an inverted second horizontal position, the ball rests in the conical top and does not contact the exposed member; and when the switch is moved to a vertical position, the ball contacts the exposed member and either the conical top or conical bottom, such that electric communication is established between the battery positive terminal, the exposed member, one of either the conical top or bottom, and the positive contact member.

In another embodiment, the actuator switch further comprises a post in electric communication with the conical top and bottom, and the housing further comprises a conductive housing member against which the post bears, the conductive housing member being in electric communication with the positive contact member, the electric communication between the conical top and bottom and the positive contact member being through the post and conductive housing member.

In another embodiment, the first electric sub-assembly comprises an electromagnetic vibrator.

In another embodiment, the second electric sub-assembly comprises a transformer.

In another embodiment, the negative contact member is permanently attached to the gun handle.

In another embodiment, the negative contact member is attached to the gun handle using a non-conductive adhesive material.

In another embodiment, the negative contact member is magnetically and removably attached to the gun handle.

In another embodiment, the negative contact member has a first layer being magnetic, a second layer being non-conductive, and a third layer being conductive.

In another embodiment, the negative contact member is further positioned on the gun barrel, such that when the housing is positioned in the gun handle, a person's hand grasping the gun barrel will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

In another embodiment, the negative contact member is permanently attached to the gun barrel.

In another embodiment, wherein the negative contact member is attached to the gun handle using a non-conductive adhesive material.

In another embodiment, the negative contact member is magnetically and removably attached to the gun barrel.

In another embodiment, the negative contact member has a first layer being magnetic, a second layer being non-conductive, and a third layer being conductive.

In another embodiment, the negative contact member is further positioned on the trigger guard, such that when the housing is positioned in the gun handle, a person's hand grasping the trigger guard will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

In another embodiment, the negative contact member is permanently attached to the gun trigger guard.

In another embodiment, wherein the negative contact member is attached to the gun trigger guard using a non-conductive adhesive material.

In another embodiment, the negative contact member is magnetically and removably attached to the gun trigger guard.

In another embodiment, the negative contact member has a first layer being magnetic, a second layer being non-conductive, and a third layer being conductive.

In another embodiment, the amperage at the positive contact member is between 1 and 5 milliamps.

In another embodiment, the negative contact member is attached to a stiff frame extending from the housing, the stiff frame being fastenable to the gun barrel, the stiff frame being adapted to be generally proximate the gun barrel, trigger guard and gun handle, when the housing is positioned in the gun handle and the stiff frame is fastened to the gun barrel.

In another embodiment, the gun barrel has a bore, and the stiff frame has a plug, the plug being adapted for close receipt by the gun barrel bore to fasten the stiff frame to the gun barrel.

In another embodiment, the electrical assembly further comprises an audio generating device, the audio generating device creating audible sounds when the actuator switch is on.

In another embodiment, the audio generating device generates an alarm sound.

In another embodiment, the audio generating device generates a recorded voice message.

In one embodiment, a device is provided for deterring the grasping of a handgun by a person's hand, the handgun having a metal frame with a handle, trigger guard and a barrel, the handle having a hollow interior, the device being powered by a battery having a positive terminal and a negative terminal, the device comprising: a housing, the housing being adapted to be received and secured at least partially within the gun handle hollow interior; and an electrical assembly at least partially within the housing, the electrical assembly being in electric communication with the positive and negative terminals of the battery, the electrical assembly having: a first electrical subassembly for converting the battery DC to pulsating DC; a second electrical subassembly for increasing the pulsating DC voltage; an actuator switch, the actuator switch moving from off to on when the gun is moved from a horizontal position; a positive contact member receiving the increased voltage pulsating DC from the second electrical sub-assembly, the positive contact member being positioned on the housing such that the gun metal frame receives pulsating DC from the positive contact member; and a negative contact member positioned adjacent the gun handle such that the negative contact member is insulated from the gun metal frame and in electric communication with the battery negative terminal, such that when the housing is positioned in the gun handle hollow interior, a person's hand grasping the gun handle will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

In one embodiment, a device is provided for deterring the grasping of a handgun by a person's hand, the handgun having a handle, the handle having a hollow interior, the device being powered by a battery having a positive terminal and a negative terminal, the device comprising: a housing, the housing being adapted to be received and secured at least partially within the gun handle interior; and an electrical assembly at least partially within the housing, the electrical assembly being in electric communication with the positive and negative terminals of the battery, the electrical assembly having: an actuator switch, the actuator switch moving from off to on when the gun is moved from a horizontal position; and an electrical audio member for generating audible sounds when the actuator switch is moved from the horizontal position.

In another embodiment, the audio generating device generates an alarm sound.

In another embodiment, the audio generating device generates a recorded voice message.

In one embodiment, a device is provided for deterring the grasping the handgun by a person's hand, the handgun having a metal frame with a handle, trigger guard and a barrel, the handle being adapted to receive a magazine, the device being powered by a battery having a positive terminal and a negative terminal, the device comprising: a housing, the housing being adapted to be received and secured at least partially within the gun handle in place of the magazine; and an electrical assembly at least partially within the housing, the electrical assembly being in electric communication with the positive and negative terminals of the battery, the electrical assembly having: converting means for converting the battery DC to pulsating DC; increasing voltage means for increasing the pulsating DC voltage; switching means for switching the DC from off to on with respect to activating the converting means and the increasing voltage means, the switch to on being caused when the gun is moved from a horizontal position; means for delivering the increased voltage pulsating DC to the gun metal frame; and negative terminal contact means for establishing electric communication between the person's hand on the gun handle and the battery negative terminal, such that when the person grasps the gun handle the person's hand will simultaneously contact the gun metal frame and the negative terminal contact means, and further, when the person moves the gun from horizontal, the switching means will cause the increased voltage pulsating DC to be received into the person's hand.

In another embodiment, the negative terminal contact means is positioned on the gun barrel, such that when the housing is positioned in the gun handle, a person's hand grasping the gun barrel will simultaneously contact the gun metal frame and the negative terminal contact means, and when the gun is moved from the horizontal position, the switching means will cause the increased voltage pulsating DC to be received into the person's hand.

In another embodiment, the negative terminal contact means is positioned on the trigger guard, such that when the housing is positioned in the gun handle, a person's hand grasping the trigger guard will simultaneously contact the gun metal frame and the negative terminal contact means, and when the gun is moved from the horizontal position, the switching means will cause the increased voltage pulsating DC to be received into the person's hand.

In another embodiment, the electrical assembly further comprises means for generating an audible sound when the switching means is on.

In another embodiment, the audible sound is an alarm sound.

In another embodiment, the audible sound is a recorded voice message.

In one embodiment, a device is provided for deterring the grasping of a handgun by a person's hand, the handgun having a metal frame with a handle, trigger guard and a barrel, the handle having a hollow interior, the device being powered by a battery having a positive terminal and a negative terminal, the device comprising: a housing, the housing being adapted to be received and secured at least partially within the gun handle hollow interior; and an electrical assembly at least partially within the housing, the electrical assembly being in electric communication with the positive and negative terminals of the battery, the electrical assembly having: converting means for converting the battery DC to pulsating DC; increasing voltage means for increasing the pulsating DC voltage; switching means for switching the DC from off to on with respect to activating the converting means and the increasing voltage means, the switch to on being caused when the gun is moved from a horizontal position; means for delivering the increased voltage pulsating DC to the gun metal frame; and negative terminal contact means for establishing electric communication between the person's hand on the gun handle and the battery negative terminal, such that when the person grasps the gun handle the person's hand will simultaneously contact the gun metal frame and the negative terminal contact means, and father, when the person moves the gun from horizontal, the switching means will cause the increased voltage pulsating DC to be received into the person's hand.

In one embodiment, a device is provided for deterring the grasping of a handgun by a person's hand, the handgun having a handle, the handle having a hollow interior, the device being powered by a battery having a positive terminal and negative terminal, the device comprising: a housing, the housing being adapted to be received and secured at least partially within the gun handle interior; and an electrical assembly at least partially within the housing, the electrical assembly being in electric communication with the positive and negative terminals of the battery, the electrical assembly having: audio means for generating an audible sound when the switching means is on; and switching means for switching the DC from off to on with respect to activating the audio means, the switching means switching to on when the gun is moved from a horizontal position.

To the accomplishment of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWING FIGURES

In order that the invention may be more fully understood, it will now be described, by way of example, with reference to the accompanying drawings in which.

Figure 7:
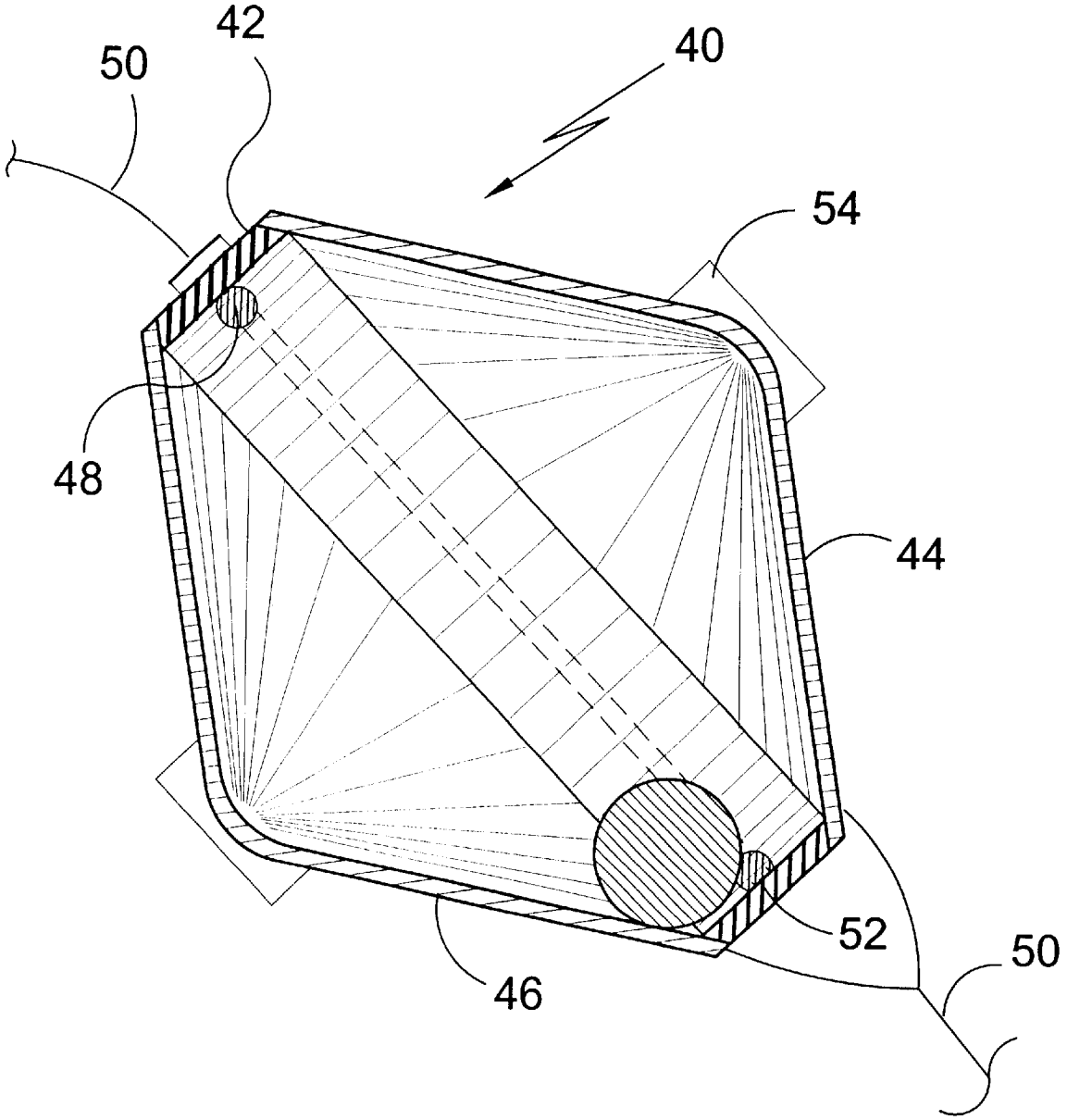

FIG. 7 is a cross sectional side view of the primary circuit actuator. When the gun is picked up and tipped and the contact ball completes the circuit between the positive exposed wire member and the conductive conical bottom resulting in pulsating DC being distributed throughout the metal frame of the gun. The contact ball and the exposed wire member may be silver plated and contained in a vacuum for increased conductivity.

Figure 8:
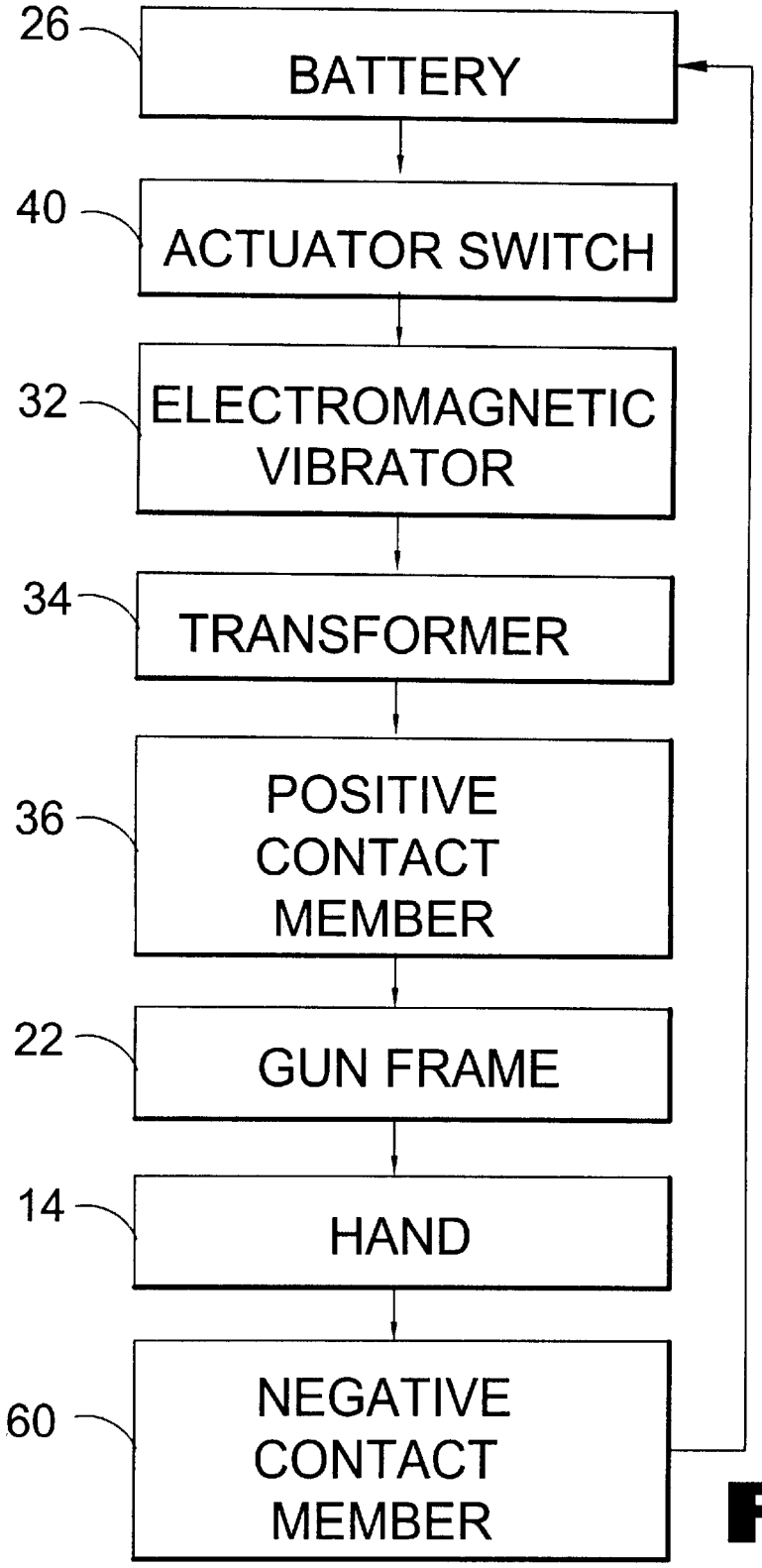

FIG. 8 is a block diagram of the present invention. Shown are the components of the present invention and the circuit completed by the hand and the movement of the actuator switch.

Figure 9:
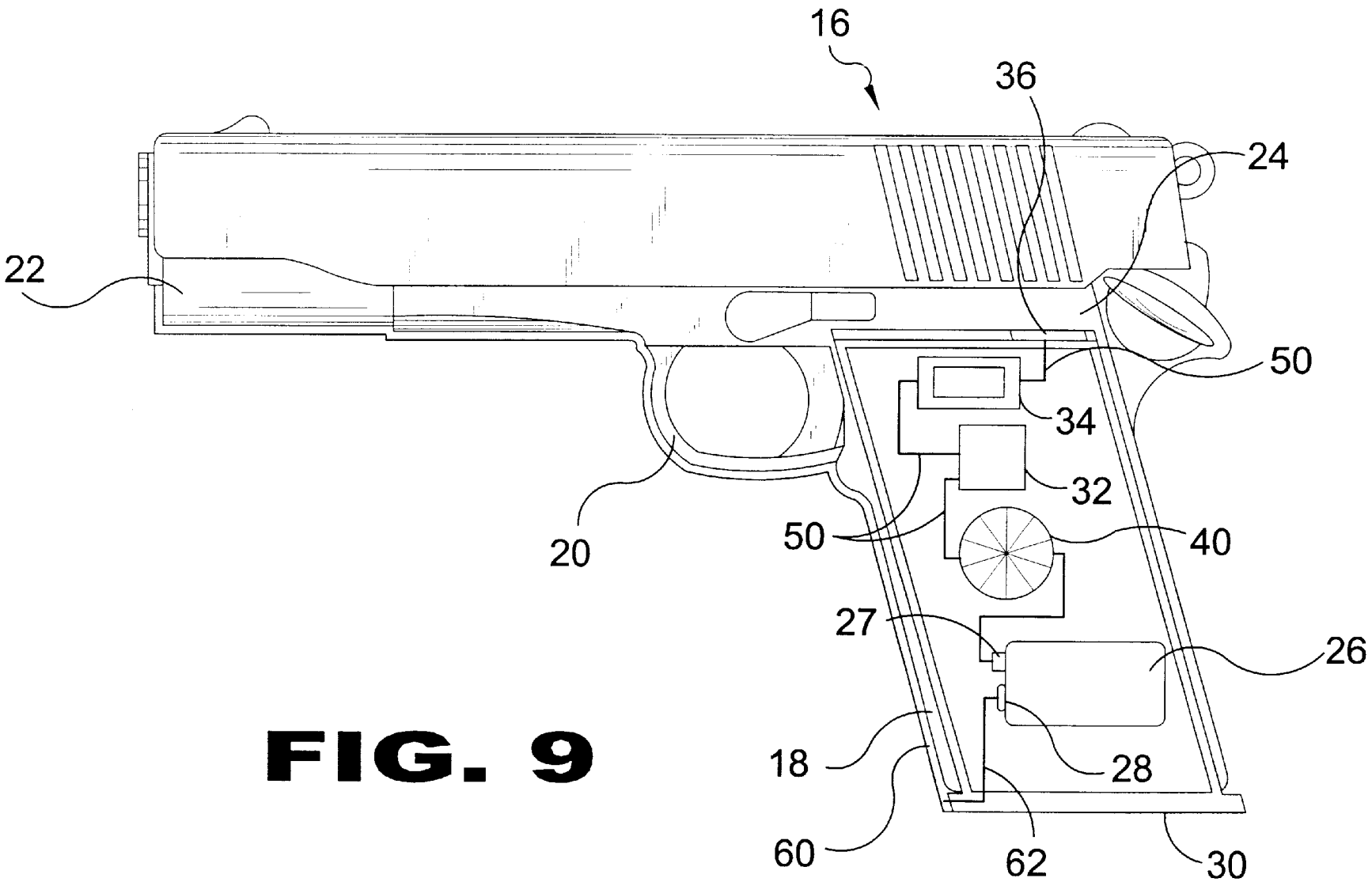

FIG. 9 is a side view of the handgun with the handle cut away to expose representatively depicted components of the electrical assembly.

Figure 10:
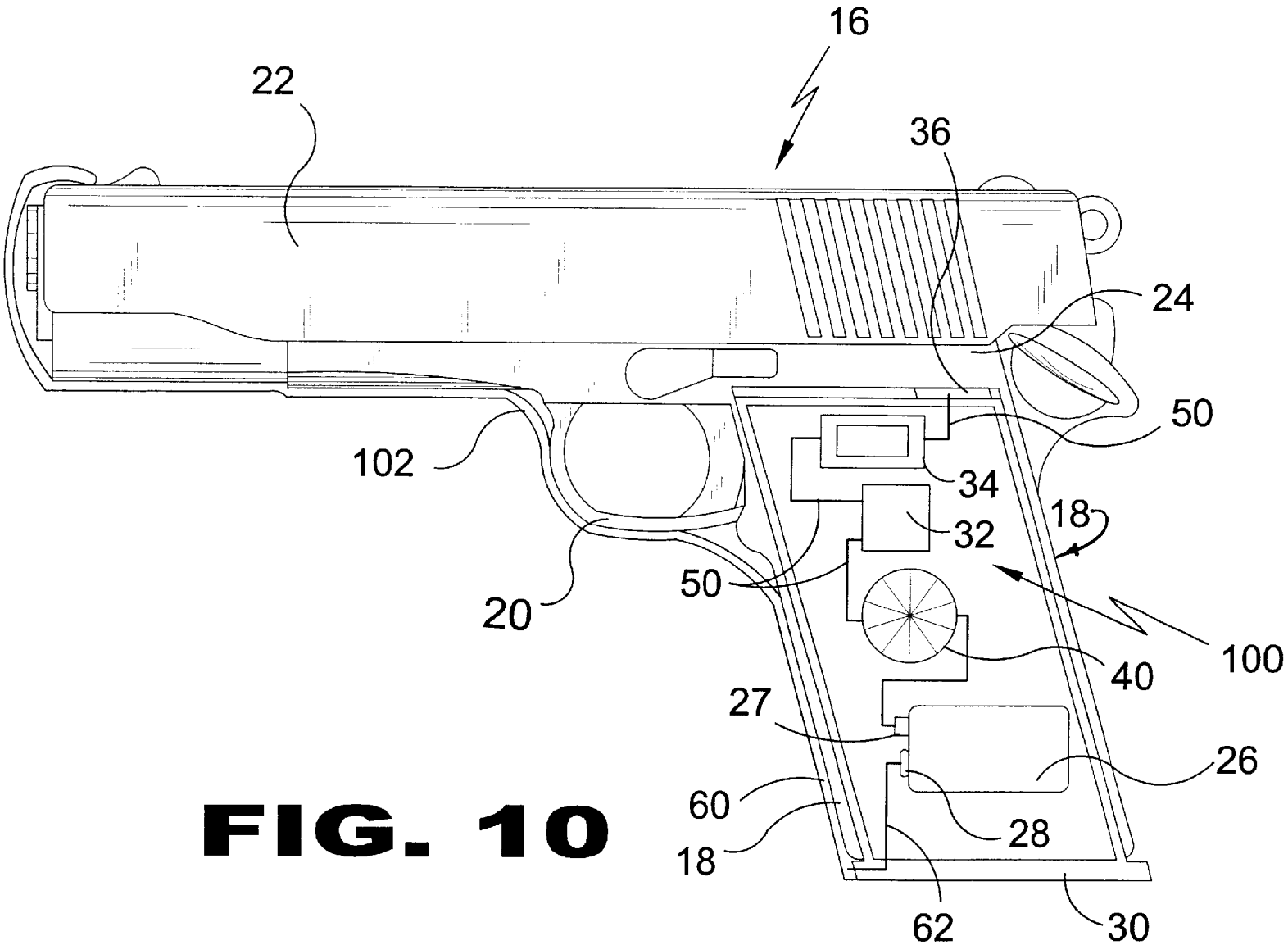

FIG. 10 is aside view of the handgun with the handle cut away to expose representatively depicted components of the electrical assembly. In this alternate embodiment the negative contact member is magnetically attached.

Figure 11:
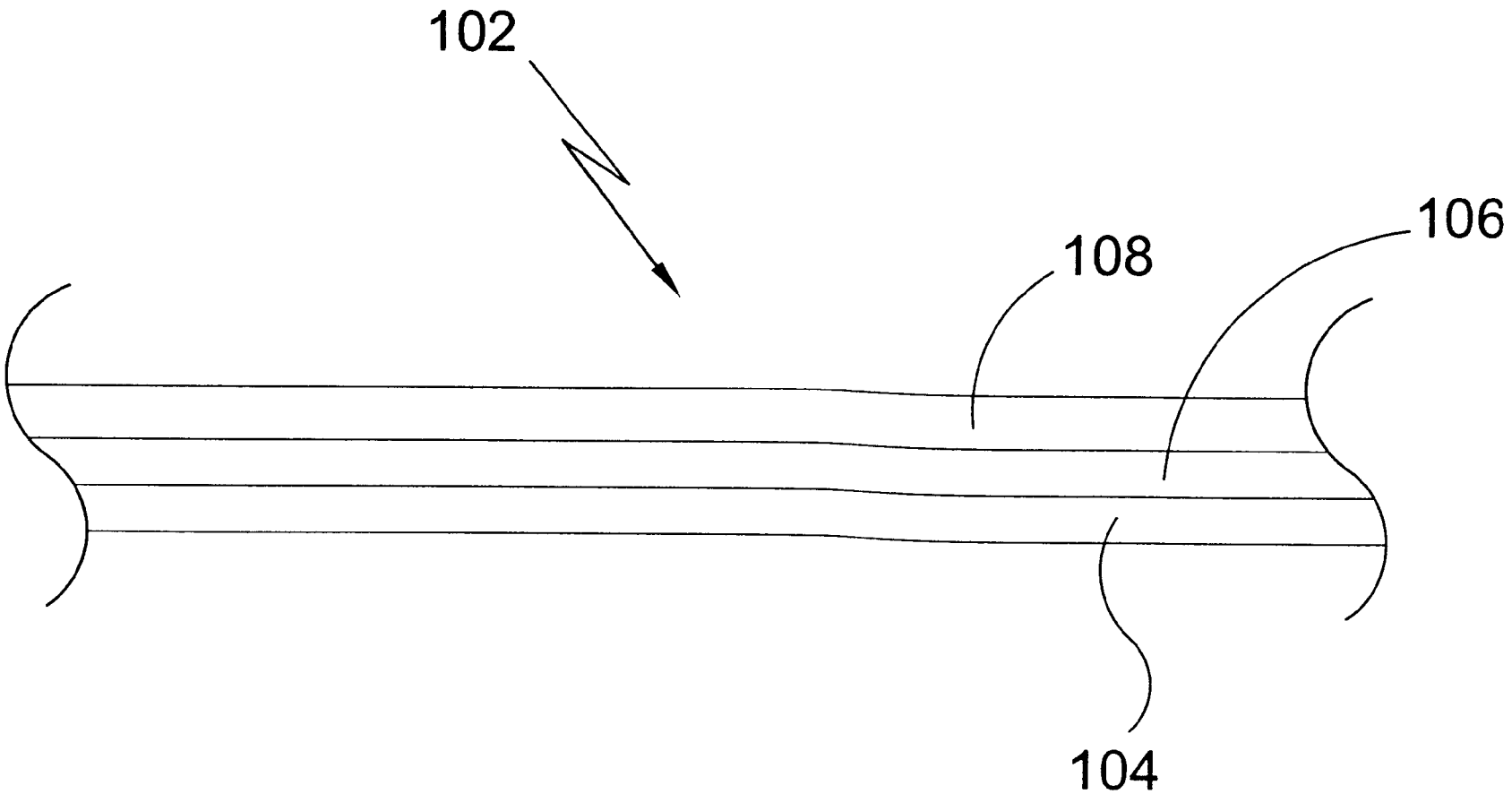

FIG. 11 is a side view of a portion of the negative contact member of the FIG. 10 embodiment revealing the various layers, including the magnetic layer.

Figure 12:
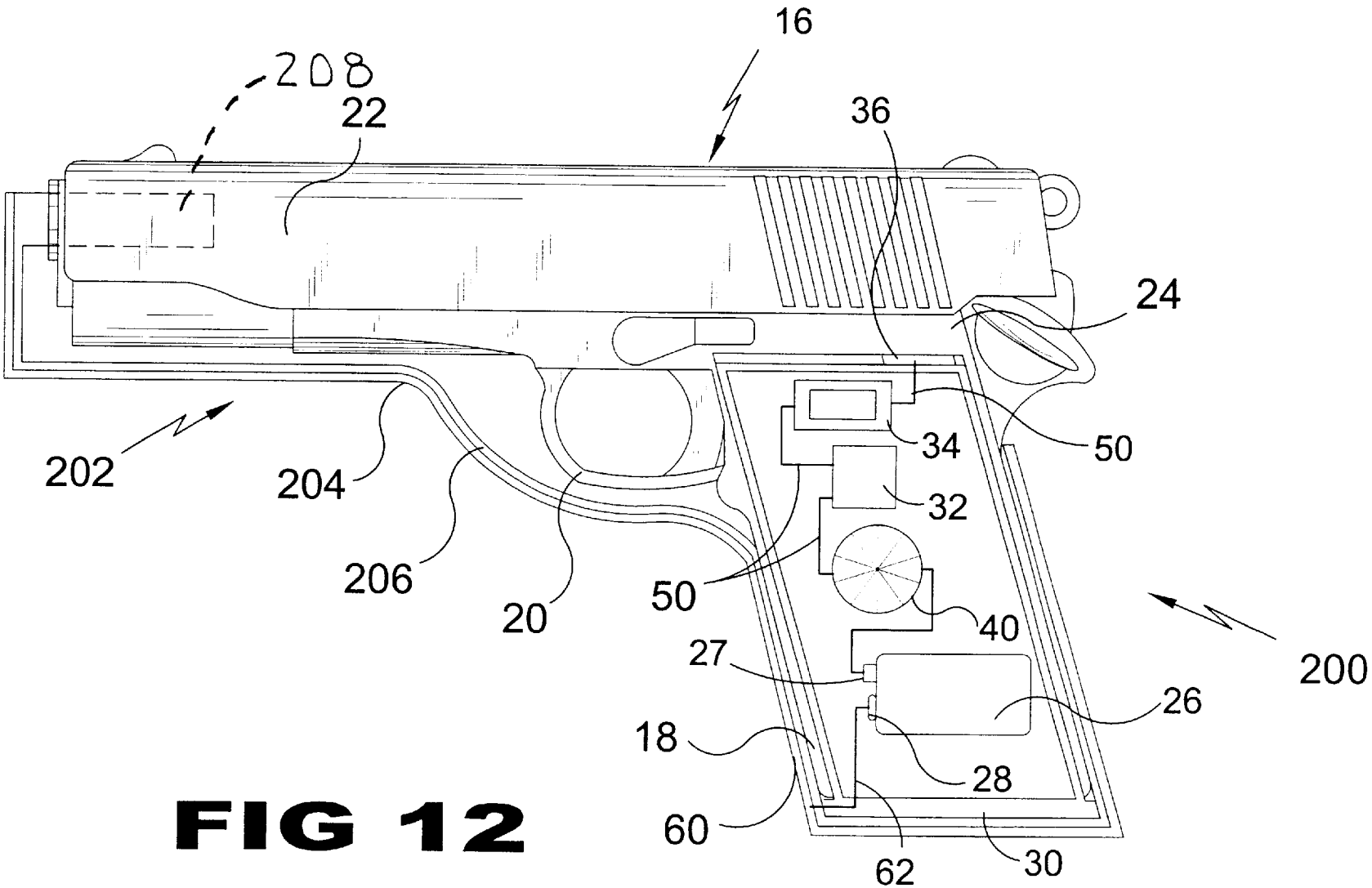

FIG. 12 is a side view of the handgun with the handle cut away to expose representatively depicted components of the electrical assembly. In this alternate embodiment the negative contact member is attached using a stiff plastic member with a fastening member in the form of a barrel plug.

Figure 13:
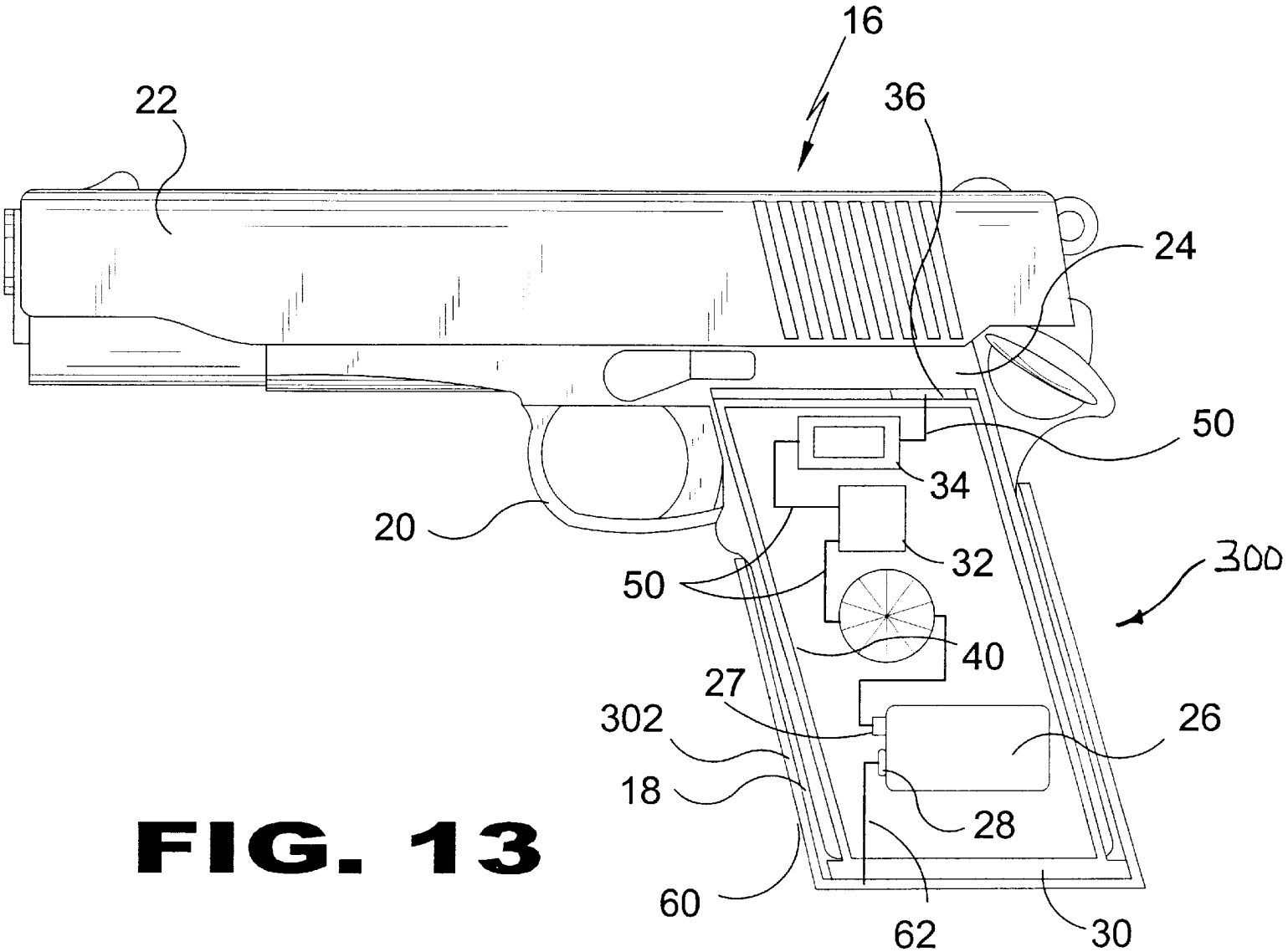

FIG. 13 is a side view of the handgun with the handle cut away to expose representatively depicted components of the electrical assembly. In this alternate embodiment the negative contact member is attached to the housing and extends to two sides of the gun handle.

Figure 14:
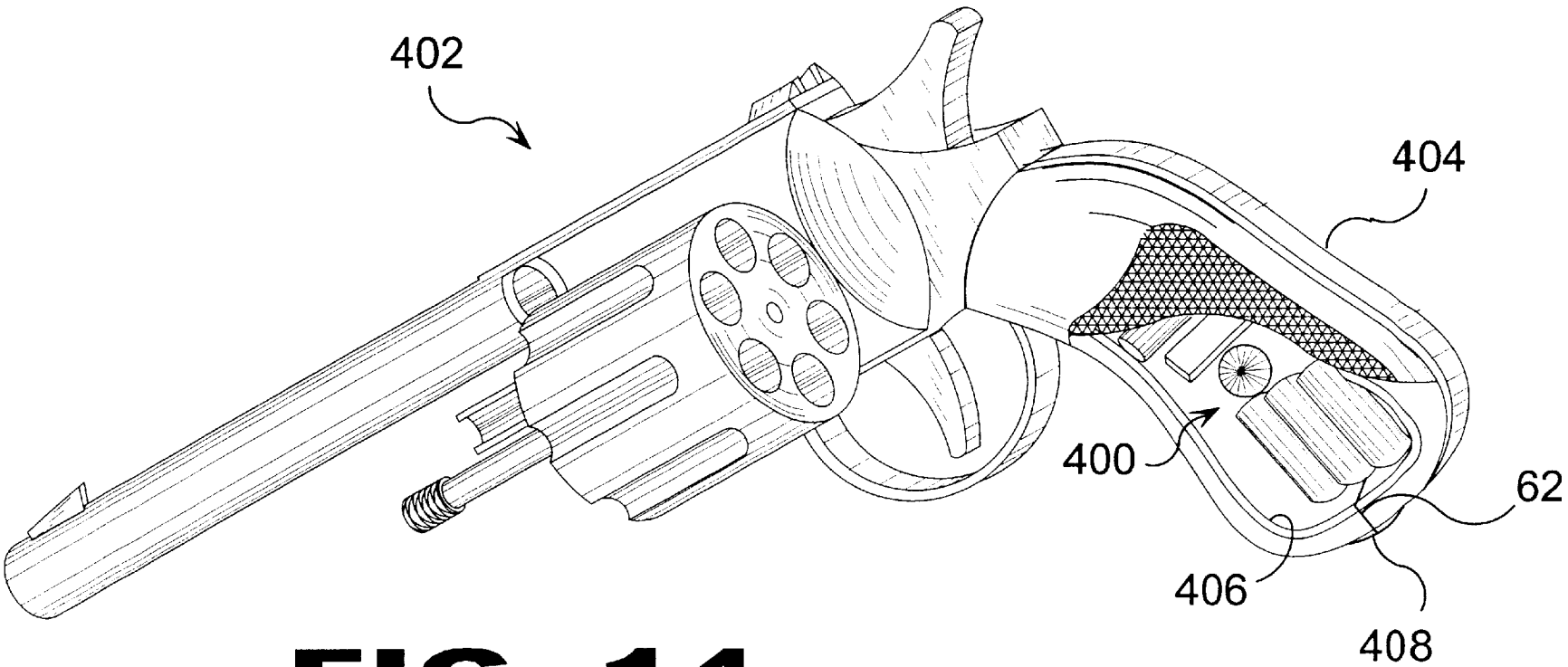

FIG. 14 is a perspective view of the present invention installed within the frame of a revolver, with the handle side removed to reveal the electrical assembly. The present invention could be adapted for use with revolvers or could also be integrated within a mock handgun that would be used specifically for conditioning a child to respect handling guns.

Figure 15:
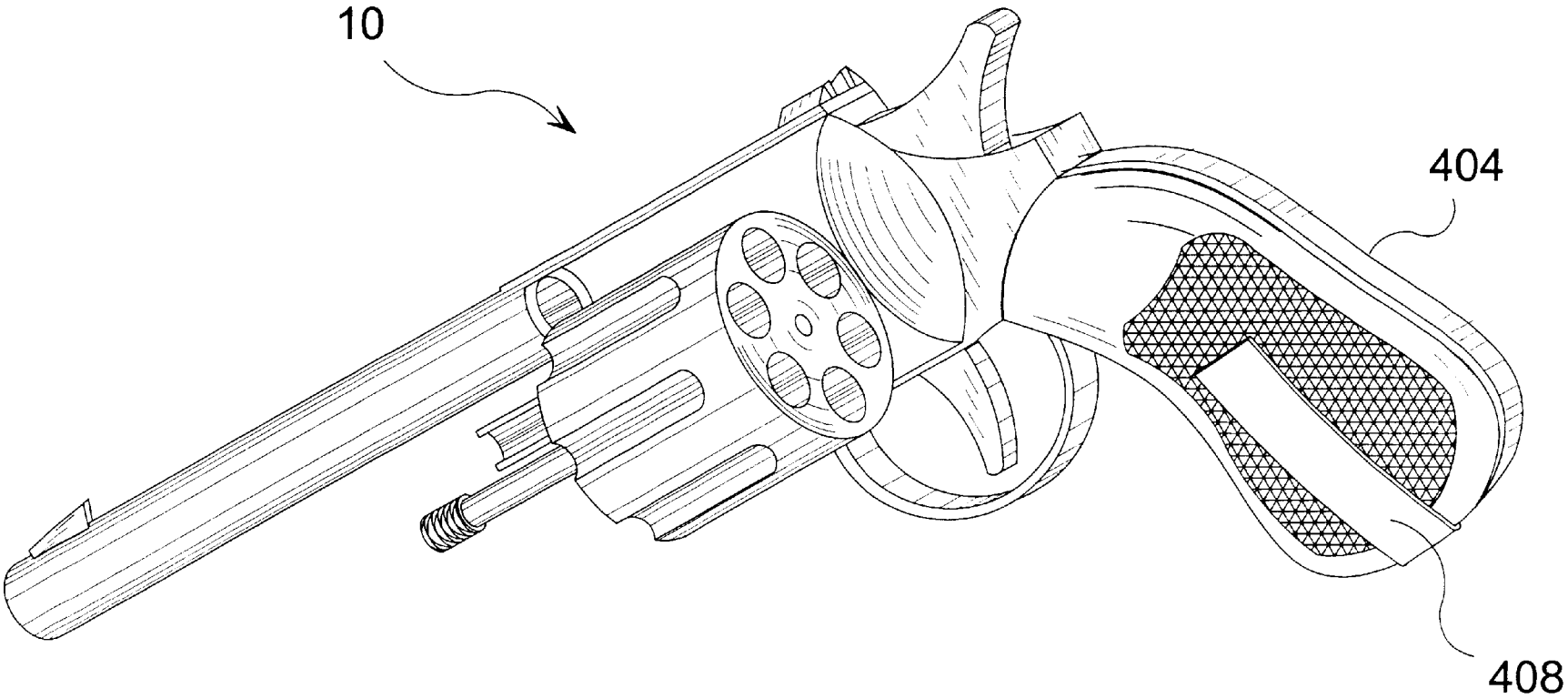

FIG. 15 is a perspective view of a revolver with the present invention installed within the frame with the handle side attached and the negative contact member shown adjacent the handle side.

Figure 16:
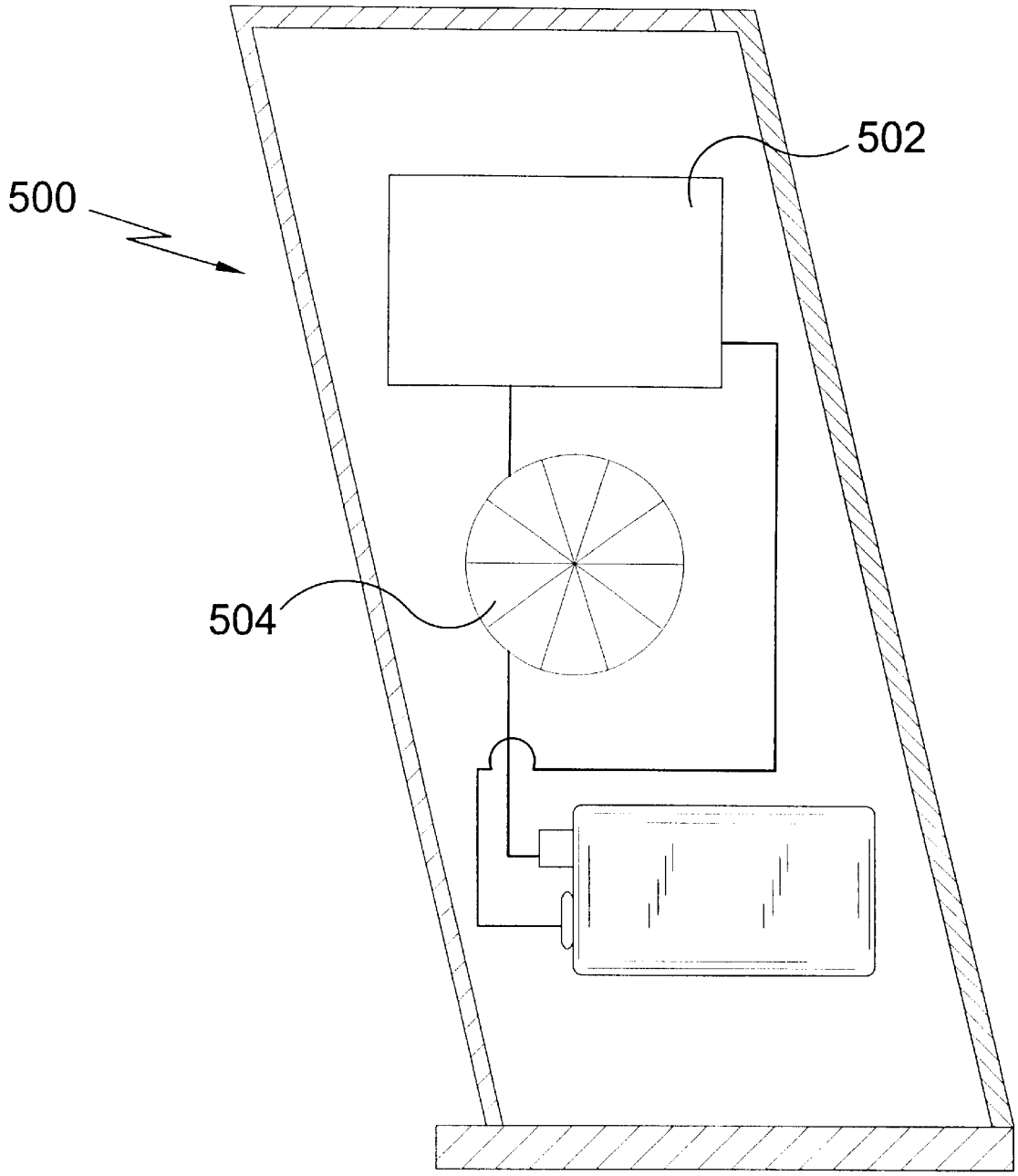

FIG. 16 is an open side view of an embodiment of the invention where the shock components are replaced by a battery powered audio generating device that is actuated by the movement of the actuator device.

Figure 17:
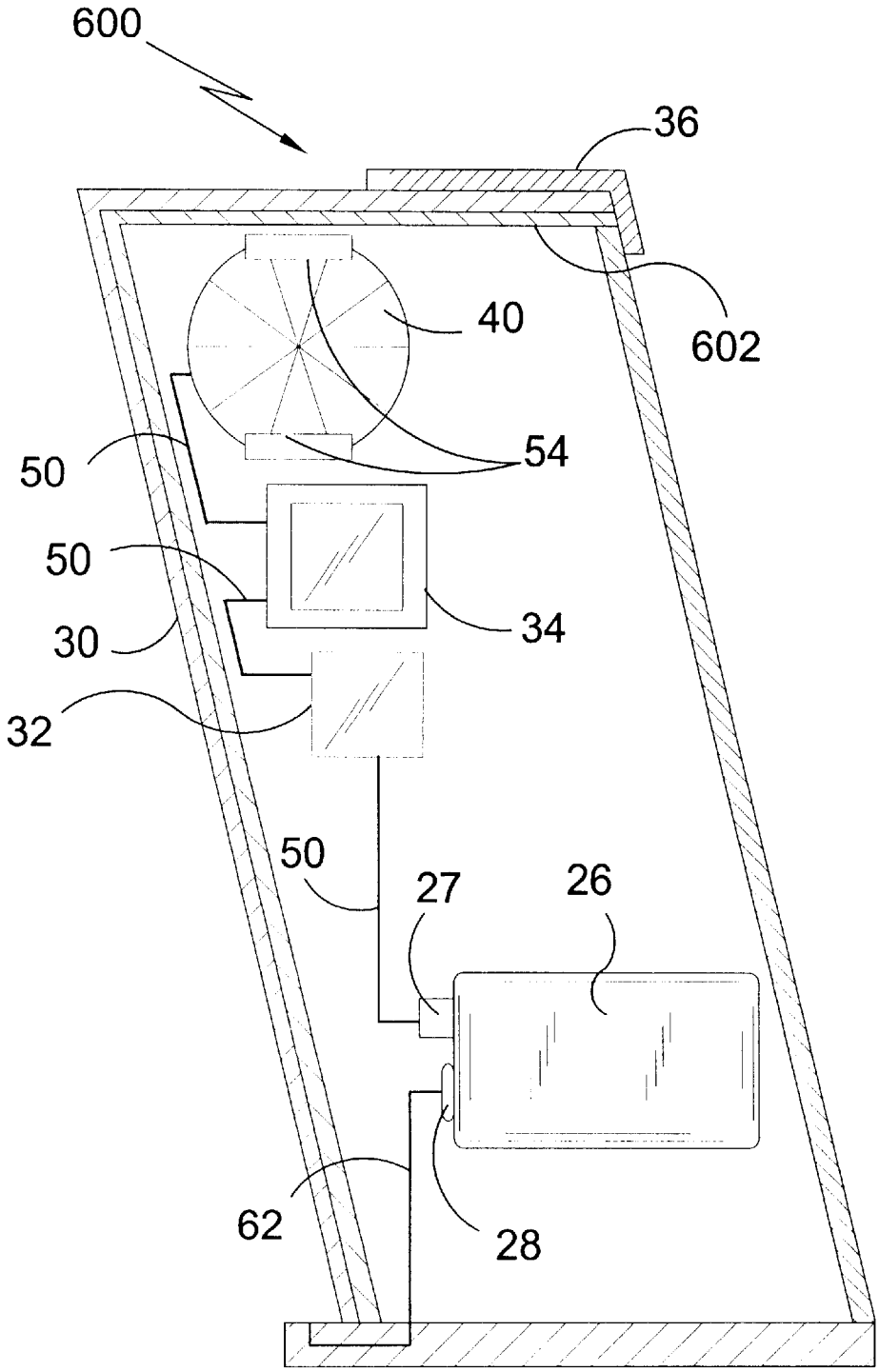

FIG. 17 is an open side view of an embodiment of the invention where the actuator switch has conductive posts in electric communication with a conductive member integrated within the housing.

DESCRIPTION OF THE REFERENCED NUMERALS

Turning now descriptively to the drawings, in which similar reference characters denote similar elements throughout the several views, the figures illustrate the Behavior Modification Device for Handguns of the present invention. With regard to the reference numerals used, the following numbering is used throughout the various drawing figures.

10 Behavior Modification Device for Handguns of the present invention
12 child
14 hand
16 automatic handgun
18 handle
20 trigger guard
22 barrel
24 gun metal frame
26 battery
27 battery positive end
28 battery negative end
30 housing
32 electromagnetic vibrator
34 transformer
36 positive contact member
40 actuator switch
42 actuator switch sidewall
44 actuator switch conical top
46 actuator switch conical bottom
48 actuator switch exposed member
50 positive leads
52 actuator switch ball
54 actuator switch posts
60 negative contact member
62 negative leads
100 alternate embodiment
102 negative contact member
104 negative contact member magnetic layer
106 negative contact member non-conductive layer
108 negative contact member conductive layer
200 alternate embodiment
202 negative contact member
204 conductive member
206 stiff member
208 fastening member
300 alternate embodiment
302 negative contact member
400 alternate embodiment
402 revolver
404 revolver handle
406 housing
408 negative contact member
500 alternate embodiment
502 audio generating device
504 actuator switch
600 alternate embodiment
602 integrated conductive member

DETAILED DESCRIPTION OF THE PREFERRED EMBODIMENT

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
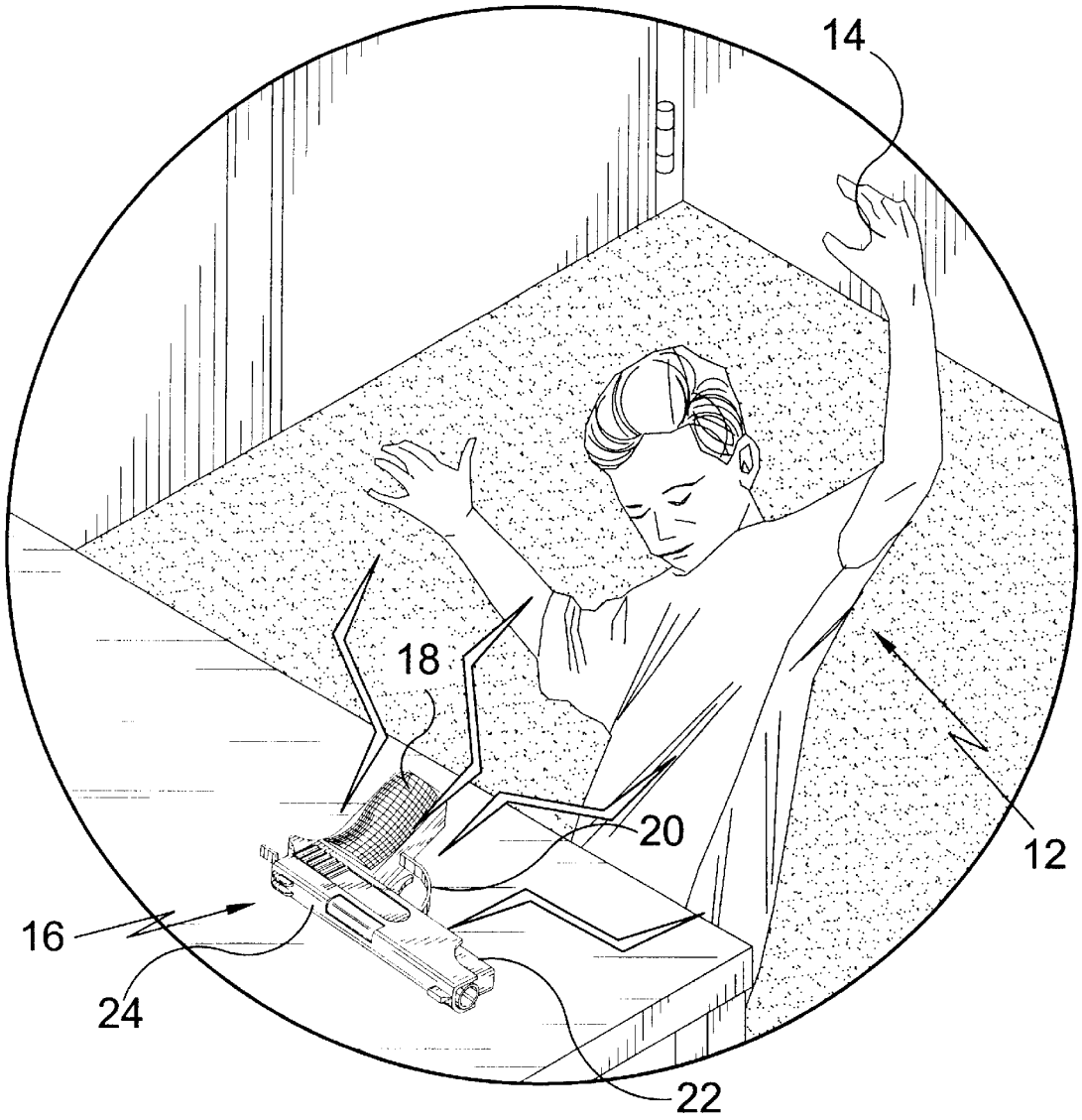
FIG. 1 is a perspective view of the present invention in use. The present invention is a behavior modification device utilizing negative reinforcement to teach children gun safety by transferring a mild electrical shock through the metal components of a gun to the person handling it when the gun is removed from the horizontal position.

FIG. 1 depicts a "shock event" where the child 12 has had his hand 14 shocked after grasping the gun 16 by the handle 18, the trigger guard 20, or the barrel 22. FIGS. 2–17 depict various embodiments of the Behavior Modification Device for Handguns 10,100,200,300,400,500, 600 of the present invention. The gun 16 has a metal frame 24 and the device 10,100,200,300,400,500,600 is powered by one or more batteries 26 having a positive terminal 27 and a negative terminal 28.

Figure 2:
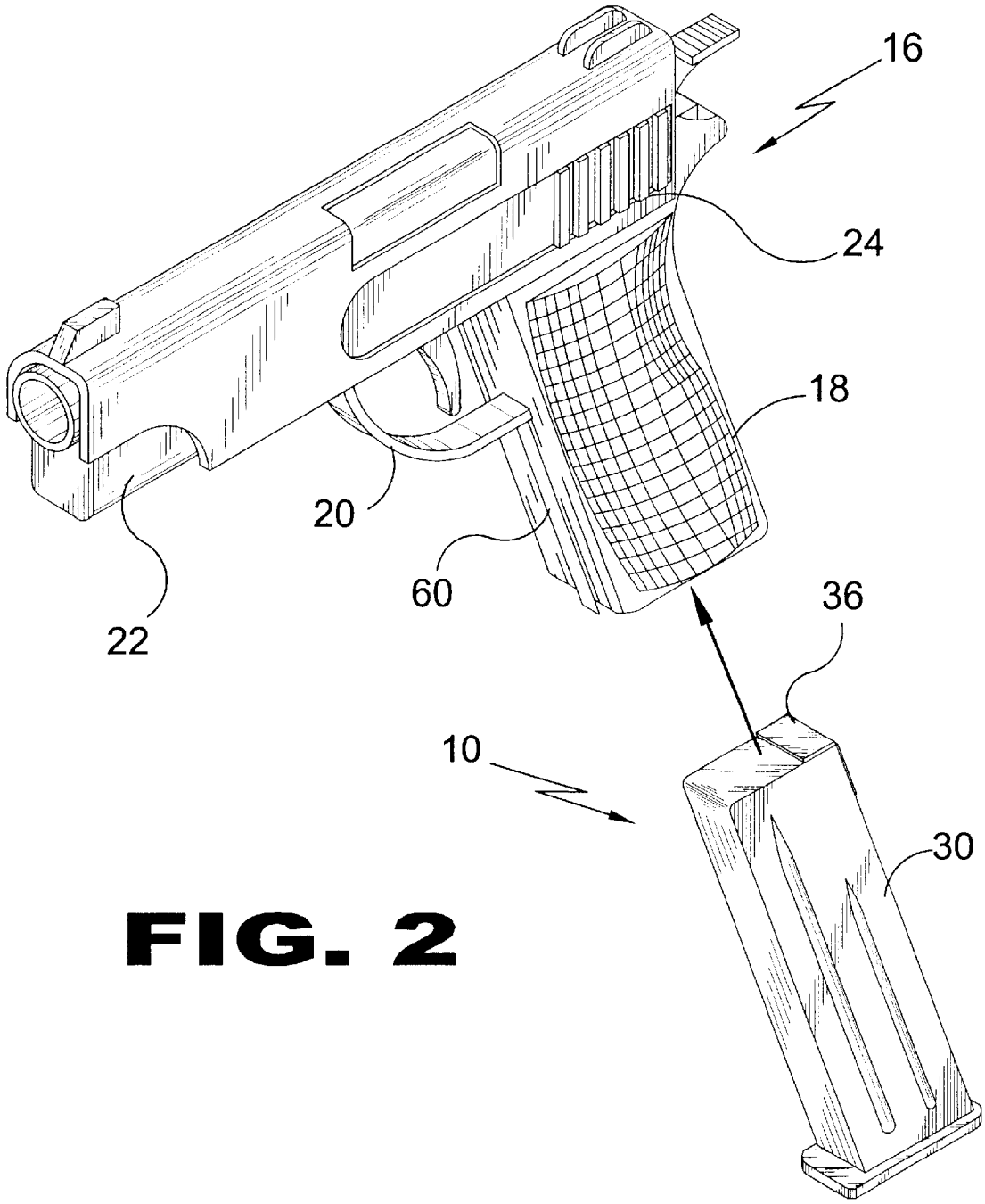
FIG. 2 is a perspective view of the present invention as applied to a semi-automatic handgun. The present invention is housed within a magazine-shaped housing when used with semi-automatic handguns and is installed by inserting the housing as if loading the gun.
Figure 3:
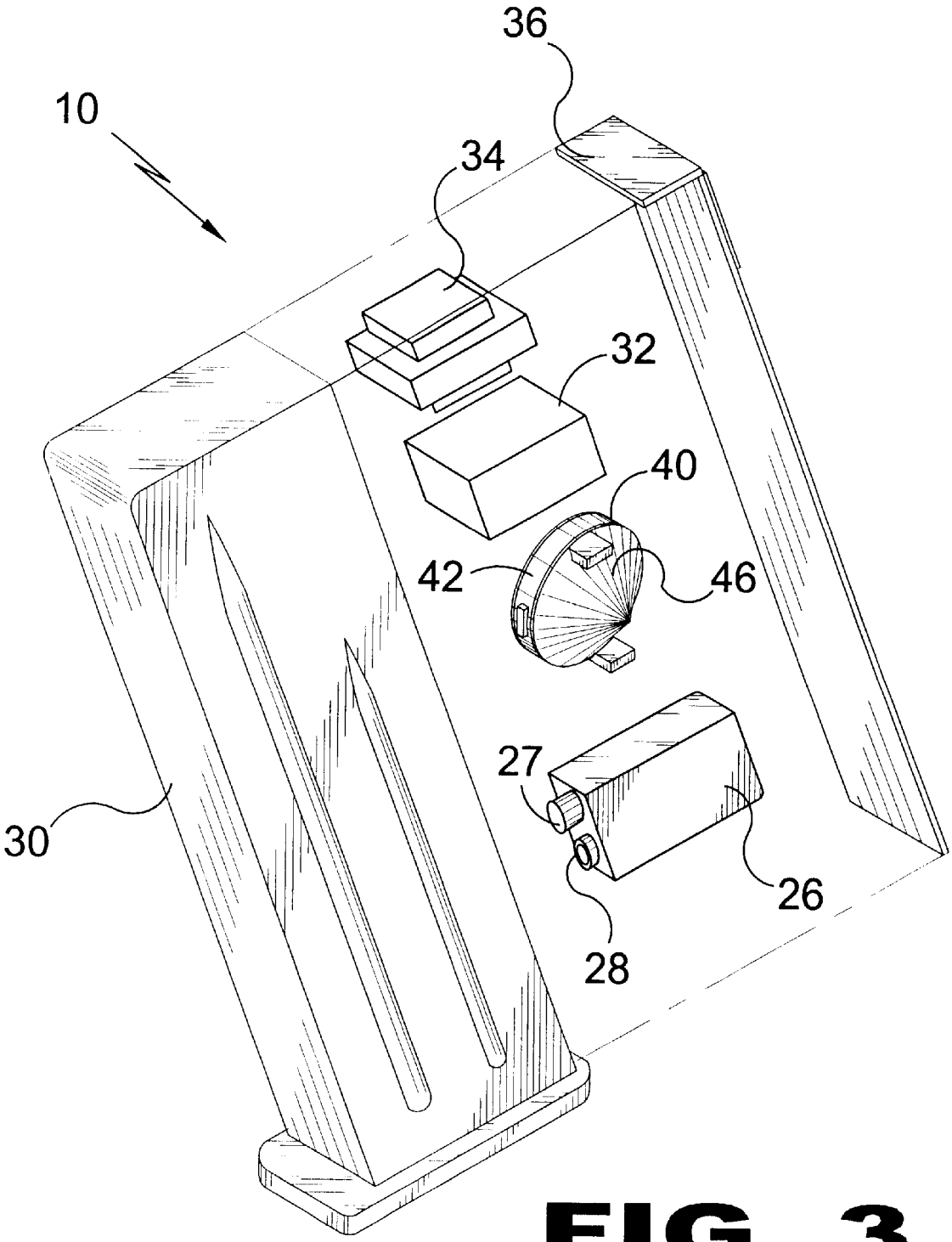
FIG. 3 is an exploded view of the present invention as applied to a semi-automatic handgun.
Figure 4:
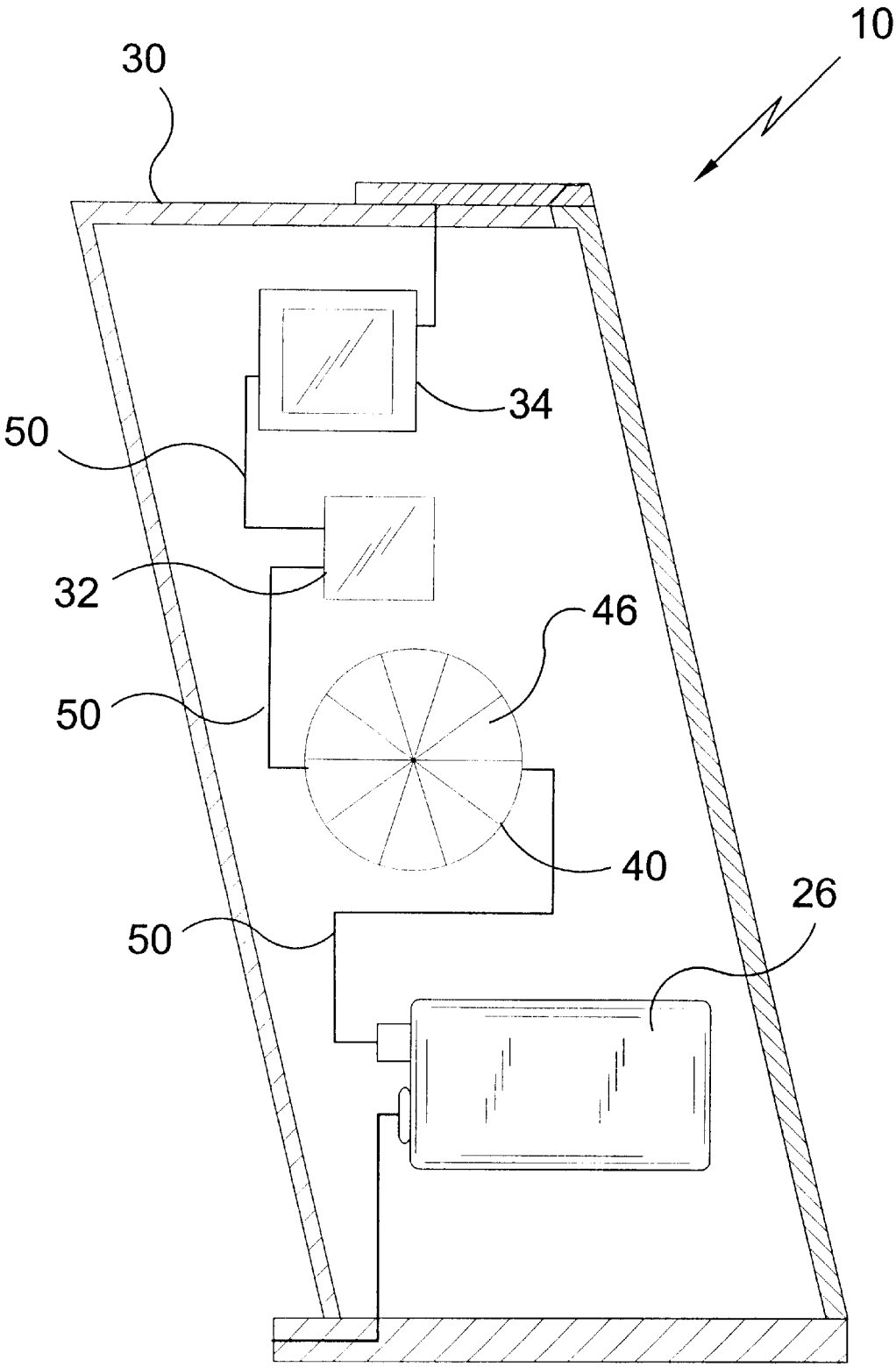
FIG. 4 is a cross sectional side view of the present invention applied to a semi-automatic handgun. This figure demonstrates one possible configuration of the components within the magazine style housing of the present invention designed for use with a semi-automatic handgun.

As shown in FIGS. 2–4, one embodiment of the device 10 has a housing 30 in the general shape of an ammunition magazine, such that the housing 30 may be inserted in the gun handle 18.

The housing 30 secures the electrical assembly, shown representatively in FIGS. 2–4 and FIGS. 8–9, including the battery 26, an electromagnetic vibrator 32, a transformer 34, a positive contact member 36, and an actuator switch 40.

The vibrator 32 receives direct current (DC) from the battery 26 and converts the current to pulsating DC. The pulsating DC is received by the transformer 34 primary. The transformer 34 secondary steps up the voltage. The desired level of stepped up voltage and other circuit adjustments can be accomplished using conventional means, electrical components and techniques. For example, converting battery DC to pulsating DC with stepped up voltage is described in U.S. Pat. No. 4,089,636, issued to Kenjiro Goto for a battery-ignitable cigarette lighter, and in U.S. Pat. No. 5,202,608, issued to James Johnson for an emergency lighting system. Both patents are incorporated herein by reference for all purposes, including means for converting DC to pulsating DC and means for stepping up the pulsating DC voltage.

Figure 5:
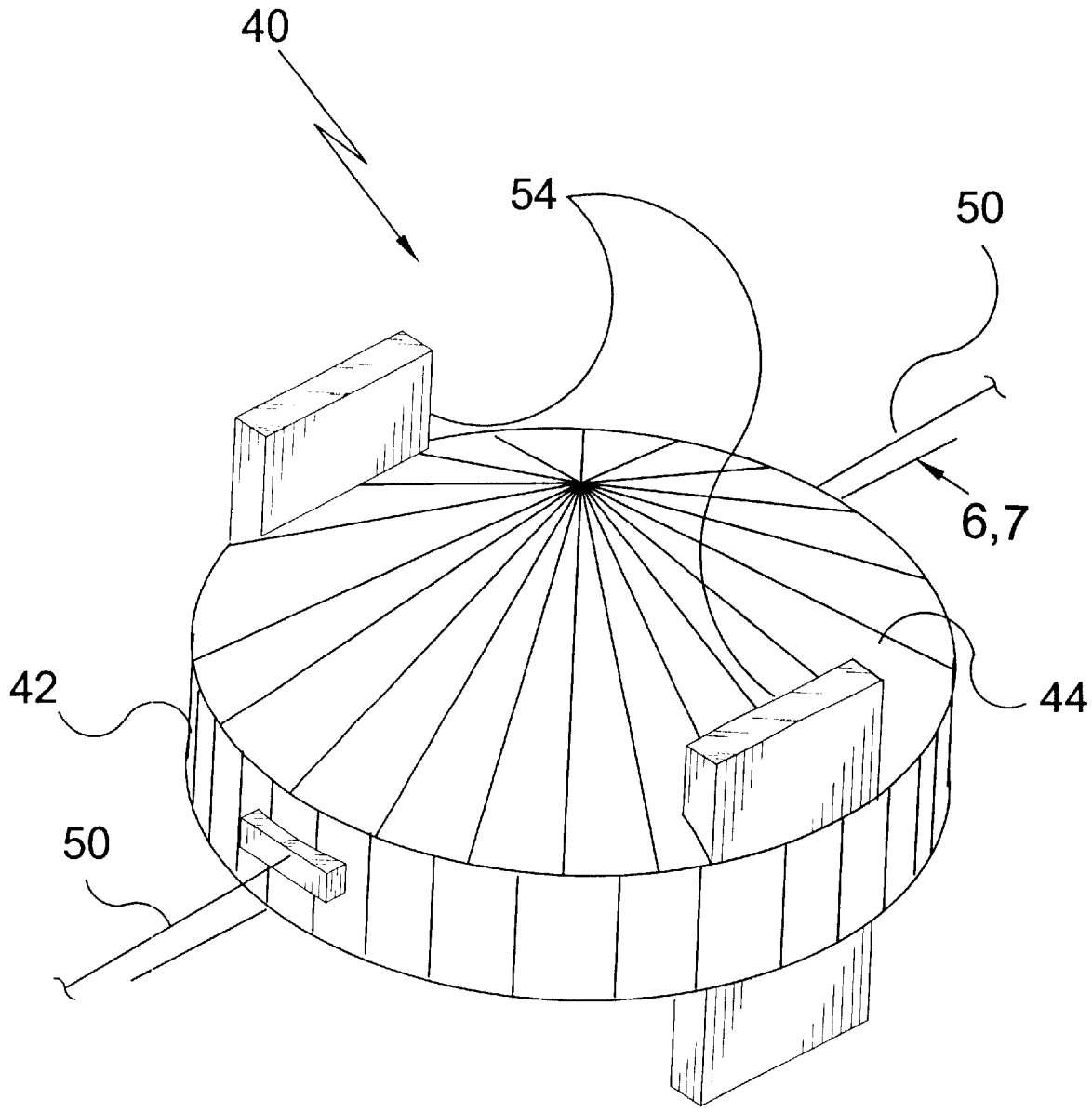
FIG. 5 is a perspective view of the actuator switch. A positive lead connects the actuator switch with the transformer.
Figure 6:
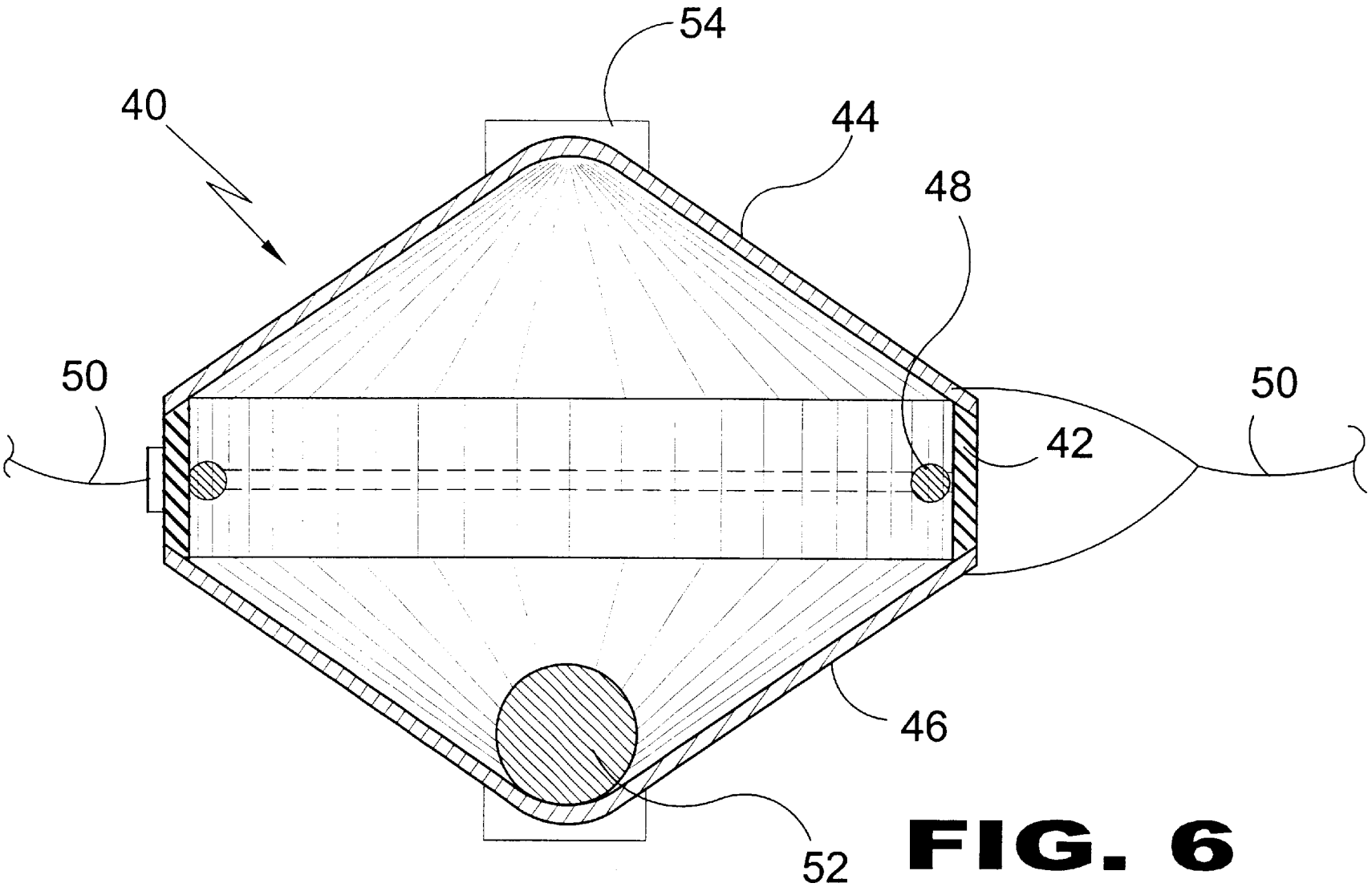
FIG. 6 is a sectional side view of the actuator switch. When the gun is lying flat the contact ball remains centered in the conical bottom and does not contact the exposed wire member, thereby leaving the circuit broken.

As shown in FIGS. 5–7, the actuator switch 40 has a circular, cylindrical sidewall 42 made of an electrically non-conductive material such as plastic. Extending from the sidewall 42 is a conical top 44 and conical bottom 46, both of which are made from conductive materials such as stainless steel. An exposed elongated member 48 is positioned on the sidewall 42 and extends about the sidewall 42 inner circumference. Positive leads 50 establish electric communication between the transformer 34 and the exposed member 48, and among the battery positive terminal 27, the electromagnetic vibrator 32, and the transformer 34.

Within the actuator switch 40 is a ball 52 that is made from a conductive material.

The actuator switch 40 is positioned within the housing 30 such that the conical top 44 is generally perpendicular to a horizontal surface and pointing upwardly when the gun is in a horizontal position. Conversely, when the gun is stored in an inverted horizontal position, the conical bottom 46 is generally perpendicular to the horizontal surface and pointing upwardly. As depicted in FIG. 6, in the first of such positions the ball 52 is nestled in the conical bottom 46 and not in contact with the exposed member 48. Movement of the gun from the horizontal causes the ball 52 to move toward the sidewall 42 where the ball 52 contacts the exposed member 48 and the conical bottom 46, thus establishing electric communication between the exposed member 48 and the conical bottom 46, as shown in FIG. 7.

Similarly, in the second of such horizontal positions the ball 52 is nestled in the conical top 44 and does not contact the exposed member 48 until the gun is moved from the horizontal. When this occurs the ball 52 rolls to the sidewall 42 and contacts both the exposed member 48 and the conical top 44.

When the ball 52 contacts either the conical top 44 or the conical bottom 46 and the exposed member 48, electric communication is established between the involved conical top 44 or bottom 46 and additional positive leads 50 that establish electric communication with a positive contact member 36 that is positioned on the housing 30 such that the positive contact member 58 will contact the gun's metal frame 24 when the housing 30 is inserted in the gun handle 18.

The posts 54 are positioned to bear against the housing 30 such that the actuator switch 40 is secured in its position.

As shown in FIG. 9, a thin, narrow, and elongated negative contact member 60 is in electric communication with the battery negative lead 62 at the base of the housing 30, when the housing 30 is in the gun handle 18. The negative contact member 60 extends from the housing 30 and the gun handle 18 and is positioned along the longitudinal length of the gun 16 including the forward and bottom surfaces of the handle 18, the trigger guard 20 and the barrel 22, all being part of the metal gun frame 24. The negative contact member 60 is electrically conductive and is insulated from the gun frame 24 by the adhesive material used to attach the negative contact member 60 to the gun metal frame components 18,20,22,24. The negative lead 62 establishes electric communication between the negative contact member 60 and the battery negative terminal 28. The negative contact member 60 is enlarged in FIG. 9 for clarity, and the juncture of the negative contact member 60 and the negative lead 62 is shown representatively, in that the actual contact of the two can be accomplished in various ways, including the direct contact of the negative lead 62 distal end with the negative contact member 60 as it extends below the end of the gun handle 18. This extension is depicted in FIG. 2 and FIG. 9. Other contact means, known in the art, are also contemplated by the present invention.

As shown in FIG. 8, the person 12 that grasps the handle 18, trigger guard 20 or barrel 22 will simultaneously contact the negative contact member 60 and the gun metal frame 24, thus establishing electric communication between the positive and negative contact members 36,60. When the gun 16 is moved from the stored horizontal position the ball 52 will actuate the circuit by simultaneously contacting the exposed member 48 and either the conical top 44 or the conical bottom 46. The increased voltage pulsating DC provided by the transformer 34 secondary is then received by the person's hand 14 causing a mild shock.

Another embodiment 100 is shown in FIGS. 10–11. In this embodiment of the device 100, the negative contact member 102 is magnetically attached to the gun frame components 18,20,22. The extended portion includes a magnetic layer 104, a non-conductive material layer 106, such as a flexible plastic, and a conductive layer 108. The negative contact member 102 is thus insulated from the gun metal frame 24. The negative contact member 102 can be permanently attached to the housing 30 for connection to the negative lead 62, or can be detachable and positionable adjacent such negative lead 62 as it is magnetically affixed to the gun frame 24.

In another embodiment 200, as shown in FIG. 12, the negative contact member 202 includes a conductive member 204 and a stiff member 206 that generally follows the contours of the gun handle 18, trigger guard 20 and barrel 22, and also includes a fastening member 208 in the form of a plug for fastening the stiff member 206 to the gun barrel 22. In use, the plug 208 is inserted into the barrel 22 and then the housing 30 is inserted into the handle 18. The stiff member's 206 rigidity deters the unintended removal of the plug 208 without first removing the housing 30. The stiff member 206 positions the conductive portion 204 for contact by the hand 14 that grasps the handle 18, trigger guard 20, or barrel 22. The negative lead 62 is shown representatively, and is detachable, using conventional means, between the base 30 and the stiff member 206, but aligned for contact after installation of the negative contact member 202.

FIG. 13 depicts another embodiment 300 wherein the negative contact member 302 extends from the housing 30 to align with both the front and rear surfaces of the gun handle 18. When the housing 30 is inserted into the gun handle 18 the negative contact member 302 will slide into such a position, with the insulated side adjacent the gun handle 18. The negative lead 62 is shown representatively and is positioned for contact with the negative contact member 302 as it is slid onto the gun handle 18.

As shown in FIGS. 14–15, the present invention includes an embodiment 400 for use on a revolver 402 having a handle 404 with a hollow interior. A reconfigured housing 406 nestles within the handle 404 from which the negative contact member 408 extrudes and is routed to lie adjacent the handle 404 exterior. The negative contact member 408 is insulated from the handle 404, and is in contact with the negative lead 62, as shown representatively in FIGS. 14–15. The establishment of the contact can be accomplished by various conventional means. The negative contact member function for the revolver 402 can also be accomplished by adaptation of the negative contact members in other embodiments discussed herein.

As representatively depicted in FIG. 16, the present invention also includes an embodiment 500 that includes an audio generating device 502 in a position to be activated by the actuator switch 504 when the gun 16 is moved from horizontal. An audible sound is emitted in that event. The audio generating device 502 can be used in conjunction with the "shock" related components, or independently In the event, it is used independently, the need for the positive and negative contact members is eliminated. The audio generating device 502 can be chosen for numerous types of sound, including recorded spoken messages and traditional alarm sounds.

In another embodiment, shown in FIG. 17, the actuator switch 40 is positioned between the transformer 34 and the positive contact member 36, and the actuator switch posts 54 are conductive. The posts 54 bear upon a conductive member 602 integrated with the housing 30. The conductive member 602 is in electric communication with the positive contact member 36 such that the non-horizontal actuator switch 40 establishes electric communication between the transformer 34 and the positive contact member 36 without the need of positive leads between the actuator switch 40 and the positive contact member 36. The contact of the negative lead 62 and the negative contact member 60 is similar to that shown in FIG. 9.

With respect to the above description then, it is to be realized that the optimum material and dimensional relationships for the parts of the invention embodiments will include variations in size, materials, shape, and form, which will occur to those skilled in the art upon review of the present disclosure. For example the various insulating materials can be constructed from various woods, glasses and plastics, and the electrical assembly can be configured for various types of batteries, and voltage levels. The negative contact members can be adapted for variously shaped handguns and for rifles and shotguns, as well as, dummy weapons having the shape of such weapons. All equivalent relationships to those illustrated in the drawings and described in the specification are intended to be encompassed by the present invention.

What is claimed as new and desired to be protected by Letters Patent is set forth in the appended claims:

1. A device for deterring the grasping of a handgun by a person's hand, the handgun having a metal frame with a handle, trigger guard and a barrel, the handle being adapted to receive a magazine, the device being powered by a battery having a positive terminal and a negative terminal, the device comprising:

a housing, the housing being adapted to be received and secured at least partially within the gun handle in place of the magazine; and an electrical assembly at least partially within the housing, the electrical assembly being in electric communication with the positive and negative terminals of the battery, the electrical assembly having:

a first electrical sub-assembly for converting the battery DC to pulsating DC;

a second electrical sub-assembly for increasing the pulsating DC voltage;

an actuator switch, the actuator switch moving from off to on when the gun is moved from a horizontal position;

a positive contact member receiving the increased voltage pulsating DC from the second electrical sub-assembly, the positive contact member being positioned on the housing such that the gun metal frame receives pulsating DC from the positive contact member; and a negative contact member positioned adjacent the gun handle such that the negative contact member is insulated from the gun metal frame and in electric communication with the battery negative terminal, such that when the housing is positioned in the gun handle, a person's hand grasping the gun handle will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

2. The device of claim 1, wherein the actuator switch comprises:

a circular member having a cylindrical wall, a conical top and a conical bottom, the wall being non-conductive, the top and bottom being conductive and in electric communication with the positive contact member, the wall having an interior surface;

an exposed member positioned about the wall interior surface circumference, the member being in electric communication with the battery positive terminal;

a ball within the cylinder, the ball being conductive, the ball being sized such that:

when the switch is in a first horizontal position, the ball rests in the conical bottom and does not contact the exposed member;

when the switch is in an inverted second horizontal position, the ball rests in the conical top and does not contact the exposed member; and when the switch is moved to a vertical position, the ball contacts the exposed member and either the conical top or conical bottom, such that electric communication is established between the battery positive terminal, the exposed member, one of either the conical top or bottom, and the positive contact member.

3. The device of claim 2, wherein the actuator switch further comprises a post in electric communication with the conical top and bottom, and the housing further comprises a conductive housing member against which the post bears, the conductive housing member being in electric communication with the positive contact member, the electric communication between the conical top and bottom and the positive contact member being through the post and conductive housing member.

4. The device of claim 1, wherein the first electric sub-assembly comprises an electromagnetic vibrator.

5. The device of claim 1, wherein the second electric sub-assembly comprises a transformer.

6. The device of claim 1, wherein the negative contact member is permanently attached to the gun handle.

7. The device of claim 6, wherein the negative contact member is attached to the gun handle using a non-conductive adhesive material.

8. The device of claim 1, wherein the negative contact member is magnetically and removably attached to the gun handle.

9. The device of claim 8, wherein the negative contact member has a first layer being magnetic, a second layer being non-conductive, and a third layer being conductive.

10. The device of claim 1, wherein the negative contact member is further positioned on the gun barrel, such that when the housing is positioned in the gun handle, a person's hand grasping the gun barrel will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

11. The device of claim 10, wherein the negative contact member is permanently attached to the gun barrel.

12. The device of claim 11, wherein the negative contact member is attached to the gun handle using a non-conductive adhesive material.

13. The device of claim 10, wherein the negative contact member is magnetically and removably attached to the gun barrel.

14. The device of claim 13, wherein the negative contact member has a first layer being magnetic, a second layer being non-conductive, and a third layer being conductive.

15. The device of claim 1, wherein the negative contact member is further positioned on the trigger guard, such that when the housing is positioned in the gun handle, a person's hand grasping the trigger guard will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

16. The device of claim 15, wherein the negative contact member is permanently attached to the gun trigger guard.

17. The device of claim 16, wherein the negative contact member is attached to the gun trigger guard using a non-conductive adhesive material.

18. The device of claim 15, wherein the negative contact member is magnetically and removably attached to the gun trigger guard.

19. The device of claim 18, wherein the negative contact member has a first layer being magnetic, a second layer being non-conductive, and a third layer being conductive.

20. The device of claim 1, wherein the amperage at the positive contact member is between 1 and 5 milliamps.

21. The device of claim 1, wherein the negative contact member is attached to a stiff frame extending from the housing, the stiff frame being fastenable to the gun barrel, the stiff frame being adapted to be generally proximate the gun barrel, trigger guard and gun handle, when the housing is positioned in the gun handle and the stiff frame is fastened to the gun barrel.

22. The device of claim 21, wherein the gun barrel has a bore, and the stiff frame has a plug, the plug being adapted for close receipt by the gun barrel bore to fasten the stiff frame to the gun barrel.

23. A device for deterring the grasping of a handgun by a person's hand, the handgun having a metal frame with a handle, trigger guard and a barrel, the handle having a hollow interior, the device being powered by a battery having a positive terminal and a negative terminal, the device comprising:

a housing, the housing being adapted to be received and secured at least partially within the gun handle hollow interior; and an electrical assembly at least partially within the housing, the electrical assembly being in electric communication with the positive and negative terminals of the battery, the electrical assembly having:

a first electrical sub-assembly for converting the battery DC to pulsating DC;

a second electrical sub-assembly for increasing the pulsating DC voltage;

an actuator switch, the actuator switch moving from off to on when the gun is moved from a horizontal position;

a positive contact member receiving the increased voltage pulsating DC from the second electrical sub-assembly, the positive contact member being positioned on the housing such that the gun metal frame receives pulsating DC from the positive contact member; and a negative contact member positioned adjacent the gun handle such that the negative contact member is insulated from the gun metal frame and in electric communication with the battery negative terminal, such that when the housing is positioned in the gun handle hollow interior, a person's hand grasping the gun handle will simultaneously contact the gun metal frame and the negative contact member, and when the gun is moved from the horizontal position, the actuator switch moves from off to on, thus completing the electrical assembly circuit and causing the person's hand to receive the increased voltage pulsating DC.

24. A device for deterring the grasping of a handgun by a person's hand, the handgun having a metal frame with a handle, trigger guard and a barrel, the handle being adapted to receive a magazine, the device being powered by a battery having a positive terminal and a negative terminal, the device comprising:

a housing, the housing being adapted to be received and secured at least partially within the gun handle in place of the magazine; and an electrical assembly at least partially within the housing, the electrical assembly being in electric communication with the positive and negative terminals of the battery, the electrical assembly having:

converting means for converting the battery DC to pulsating DC;

increasing voltage means for increasing the pulsating DC voltage;

switching means for switching the DC from off to on with respect to activating the converting means and the increasing voltage means, the switch to on being caused when the gun is moved from a horizontal position;

means for delivering the increased voltage pulsating DC to the gun metal frame, and negative terminal contact means for establishing electric communication between the person's hand on the gun handle and the battery negative terminal, such that when the person grasps the gun handle the person's hand will simultaneously contact the gun metal frame and the negative terminal contact means, and further, when the person moves the gun from horizontal, the switching means will cause the increased voltage pulsating DC to be received into the person's hand.

25. The device of claim 24, wherein the negative terminal contact means is positioned on the gun barrel, such that when the housing is positioned in the gun handle, a person's hand grasping the gun barrel will simultaneously contact the gun metal frame and the negative terminal contact means, and when the gun is moved from the horizontal position, the switching means will cause the increased voltage pulsating DC to be received into the person's hand.

26. The device of claim 25, wherein the negative terminal contact means is positioned on the trigger guard, such that when the housing is positioned in the gun handle, a person's hand grasping the trigger guard will simultaneously contact the gun metal frame and the negative terminal contact means, and when the gun is moved from the horizontal position, the switching means will cause the increased voltage pulsating DC to be received into the person's hand.

27. A device for deterring the grasping of a handgun by a person's hand, the handgun having a metal frame with a handle, trigger guard and a barrel, the handle having a hollow interior, the device being powered by a battery having a positive terminal and a negative terminal, the device comprising:

a housing, the housing being adapted to be received and secured at least partially within the gun handle hollow interior; and an electrical assembly at least partially within the housing, the electrical assembly being in electric communication with the positive and negative terminals of the battery, the electrical assembly having:

converting means for converting the battery DC to pulsating DC;

increasing voltage means for increasing the pulsating DC voltage;

switching means for switching the DC from off to on with respect to activating the converting means and the increasing voltage means, the switch to on being caused when the gun is moved from a horizontal position;

means for delivering the increased voltage pulsating DC to the gun metal frame; and negative terminal contact means for establishing electric communication between the person's hand on the gun handle and the battery negative terminal, such that when the person grasps the gun handle the person's hand will simultaneously contact the gun metal frame and the negative terminal contact means, and further, when the person moves the gun from horizontal, the switching means will cause the increased voltage pulsating DC to be received into the person's hand.

* * * * *